United States Patent [19]

Kuehnl

[11] Patent Number: 4,805,360

[45] Date of Patent: Feb. 21, 1989

[54] STRUCTURE FOR SUPPLYING GOODS AND SERVICES

[76] Inventor: George E. Kuehnl, 3657 Coronada Dr., Toledo, Ohio 43615

[21] Appl. No.: 763,972

[22] Filed: Aug. 9, 1985

Related U.S. Application Data

[63] Continuation of Ser. No. 502,296, Jun. 8, 1983, abandoned.

[51] Int. Cl.[4] ..... E02D 29/00

[52] U.S. Cl. ..... 52/169.1; 52/30; 52/169.6

[58] Field of Search ..... 52/169.1, 169.6, 30, 52/31, 236.3; 109/1,5; 44/266, 267, 285; 198/801

[56] References Cited

U.S. PATENT DOCUMENTS 709,985 9/1902 Hunter ..... 52/30

3,159,117 12/1964 Rosenfeld ..... 52/169.6 X

*Primary Examiner*—David A. Scherbel

*Assistant Examiner*—Richard E. Chilcot, Jr.

*Attorney, Agent, or Firm*—Allen D. Gutchess, Jr.

[57] ABSTRACT

A unique structure is provided for supplying goods and services to customers. The structure includes a ground level building having an openable window or the like by means of which goods or services can be dispensed to customers outside the building. Preferably, the building has at least one vehicle path extending along the side thereof for customer's automobiles. The structure also includes an underground container under the building in which workers can perform operations relative to the goods or services being dispensed. A stairs connects the underground container and the ground level building and a conveyor can be connected between the container and the building for supplying items which are to be dispensed to customers from the container to the building.

12 Claims, 2 Drawing Sheets

STRUCTURE FOR SUPPLYING GOODS AND SERVICES

This invention relates to a structure including a ground level building and an underground container for supplying goods or services to customers outside the building.

The structure in accordance with the invention provides a ground level building which can be relatively small for one or two clerks. An underground container is located under the building and is usually larger than the building, providing sufficient room for workers to process items to be supplied to the customers. At least one driveway or vehicle path is located along one side of the ground level building by means of which customers can drive up to the building. A communications post can be located alongside the path before the cars reach the building for supplying orders to the clerk or clerks in the building in the case of some types of retailing goods or services. In many instances, two driveways or vehicle paths can be provided one on each side of the building, with the one employee capable of handling vehicles on both. Stairs connect the building and the container and a conveyor also commonly connects the two to provide processed items for the customers from the container to the ground level building.

In its basic form, the underground container has sufficient height for the workers to stand and commonly will have a restroom facility at one end. In such an instance, a lift station is usually provided including a holding tank and a pump for supplying sewage to a higher level sewage pipe. Utility connections for water and electricity can also be provided along with exhaust fans and vents. For food processing, the container can be equipped with a freezer built into one end thereof, and food cooking and processing equipment and hot water tank are common. The underground container can be in the form of a prefabricated fiberreinforced plastic tank, usually filament wound; it can also be in the form of a poured-in-place or prefabricated concrete container.

Because the underground container is usually considerably larger than the ground level building, the overall structure can be constructed on small or odd-sized sites including the fringes of shopping center parking lots or the like. Such sites also are relatively low in cost or relatively inexpensive to lease.

The ground level building can be prefabricated along with the underground container and can be quickly installed. the overall structure can often be built in a period of 30 to 60 days, minimizing the tie-up of capital. Low overhead also is inherent in the structure and the number of employees can be kept at a minimum.

The retail or service structure has many uses, including fast foods, ice cream and milk, banking services, twenty-four hour prescriptions, shoe repair, dry cleaning, beer and soft drinks, post office, package-drop-off, printing, watch repairs, and short term photo development.

It is, therefore, a principal object of the invention to provide a unique structure for supplying goods or services to customers, which comprises a ground level building and an underground container communicating with the building.

Another object of the invention is to provide a structure for supplying goods or services, which structure can be prefabricated and relatively quickly installed.

A further object of the invention is to provide a structure for goods or services including a ground level building and an underground container, the structure being capable of installation on small or odd-sized sites.

Yet another object of the invention is to provide a structure for supplying goods or services including a ground level building and an underground container which requires a minimum number of employees and has low overhead.

Numerous other objects and advantages of the invention will be apparent from the following detailed description of preferred embodiments thereof, reference being made to the accompanying drawings, in which.

Figure 1:
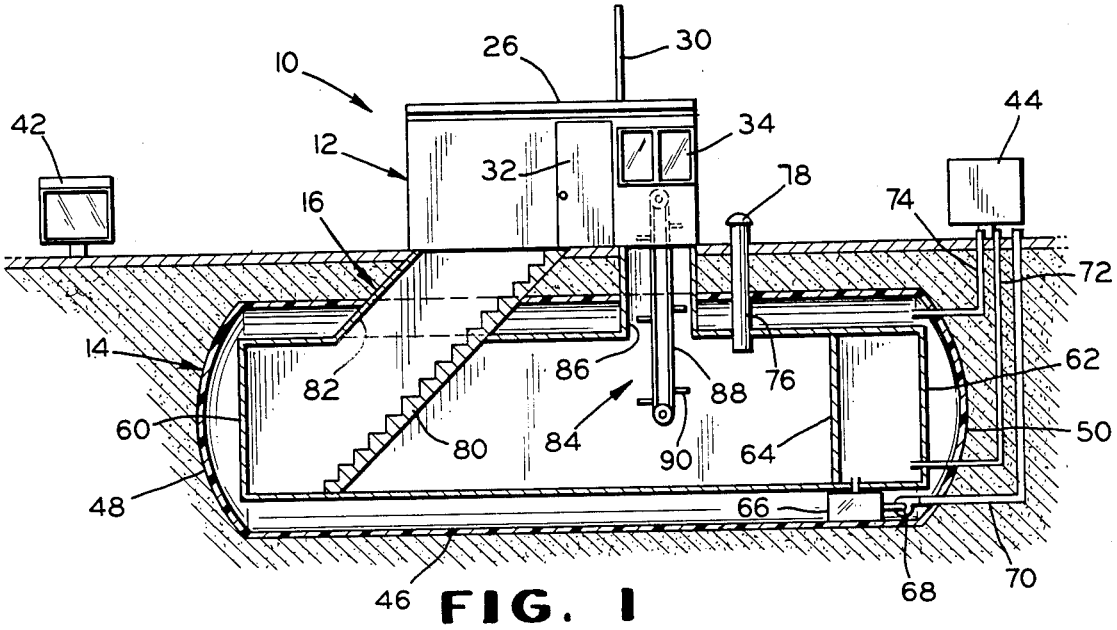
FIG. 1 is a schematic longitudinal view, partly in elevation and partly in section, of a structure embodying the invention.
Figure 2:
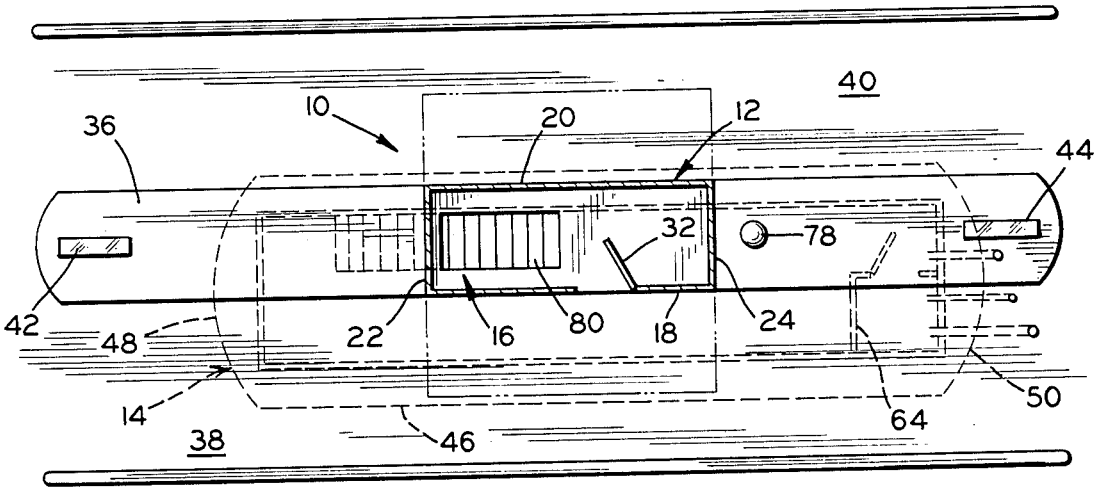
FIG. 2 is a schematic plan view, partly in section, of the structure of FIG. 1.
Figure 3:
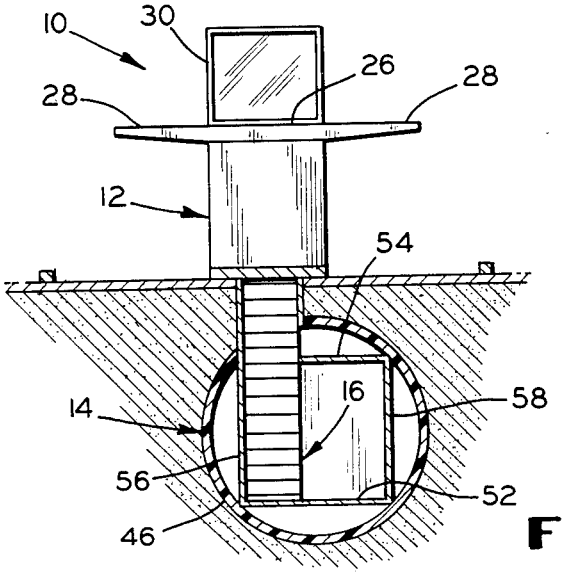
FIG. 3 is a schmetic end view, partly in elevation and partly in section, of the structure of FIGS. 1 and 2.

Referring to FIGS. 1–3, a structure for supplying goods or services to customers is indicated at 10. The structure basically includes a ground level building 12 and an underground container 14, with stair means indicated at 16 connecting the container and the building.

The ground level building 12 can be quite small, e.g. four feet by ten feet, since it will usually be occupied by only one worker, and can be prefabricated so as to be quickly installed on the site. It includes two side walls 18 and 20 and two end walls 22 and 24 with a flat roof 26 having overhangs 28 for weather protection. A large, advertising sign 30 can be mounted on the roof 26. The side wall 18 has an access door 32 and windows 34 by means of which goods or services can be dispensed to customers outside the building. The windows 34 can be openable or, in the case of a bank, for example, can have sliding trays which prevent direct access between the worker or teller and the customers.

The building 12 can be located on a concrete island 36 which need not be any or much wider than the building 12, with vehicle paths or driveways 38 and 40 located along the sides of the building 12. The width of the building 12 is such that one worker can usually handle vehicles in both of the paths 38 and 40. For such purposes as fast food retail structures, a communication station 42 can be provided for customers' vehicles in the path or driveway 38 and a communication station 44 can be provided for cutomers' vehicles in the path or driveway 40 for communicating with the worker in the building 12 and giving advance orders or the like.

The underground container 14, as shown, includes a long cylindrical shell 46 with convex end caps 48 and 50. The shell 46 can be prefabricated of glass-filament-wound reinforced plastic material for high strength and durability. This can be similar to the glass-filament-wound gasoline storage tanks which are now commonly used at gas station sites. The tank is typically twelve feet long, being larger than the ground level building 12. At least a substantial part of the container 14 is directly under a substantial part of the ground level building 12 to conserve space and enable the structure to be placed on a small site or lot. The shell 46 can have a flat floor 52 and a flat ceiling 54 which provides space with the shell therebelow and thereabove for duct work, pipes, etc. For a more finished container, side walls 56 and 58 and end walls 60 and 62 can also be provided. A partition 64 can be added near one of the end walls 60 and 62 to enclose a lavatory utilizing a lift station including a holding tank 66 and a force pump 68 for supplying sewage through a line 70 upwardly to a sewer line (not shown) which is usually at a level above the bottom of the container. Utility lines and conduits 72 and 74 can also be provided. The line 72 can be for water and the conduit 74 for electrical supply lines. A suitable vent duct 76 with a vent cap 78 can also be provided, preferably in a position to project above the ground near the ground level building 12 on the island 36. For fast food businesses, a freezer can also be built into one end of the container 14, with minimum construction.

The stair means 16 includes stairs 80 and a stair passage 82. These preferably communicate with one end portion of the shell 16 and preferably along one of the side walls 56 and 58 thereof to consume less useable space. The stair means also preferably communicates with one end portion of the ground level building 12 spaced from the dispensing windows 34. This enables the processing workers in the container 14 to enter and exit without interfering with the dispensing worker in the building 12.

In most instances, conveying means 84 are also provided between the container 14 and the building 12. The conveying means 84 includes a conveying duct or passage 86 with a dumbwaiter 88, in this instance, extending upwardly to a position near the dispensing window 34 from a central portion of the container 14. The dumbwaiter includes a belt 88 and short platforms 90 moveable therewith on which articles are placed. For larger articles, such as dry cleaning, the conveying means can be disposed along the stair means 16, being in the form of a overhead conveyor, for example, on which hangers carrying cleaned clothes are transported.

Figure 4:
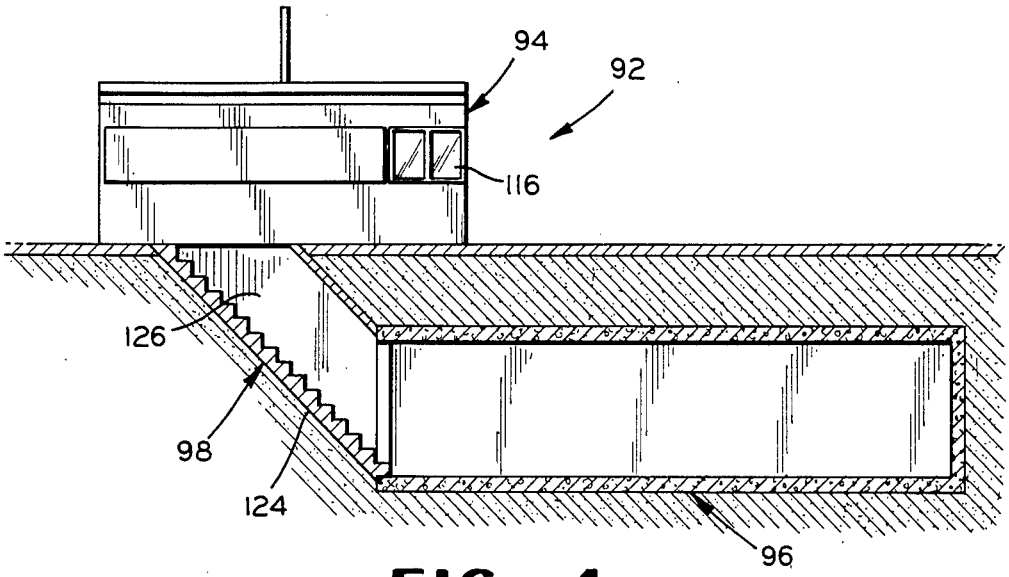
FIG. 4 is a schematic longitudinal view, partly in elevation and partly in section, of a modified structure embodying the invention.
Figure 5:
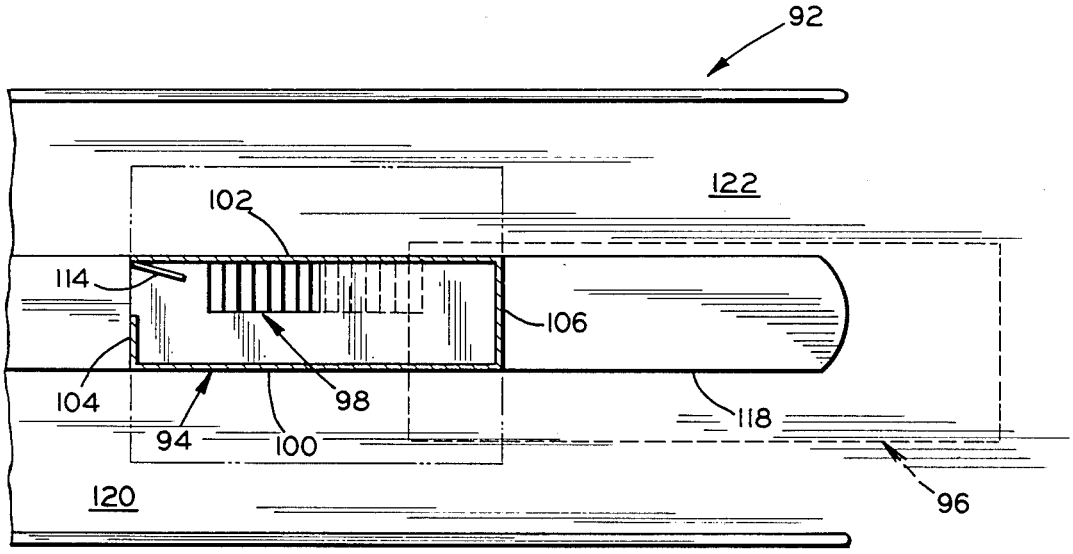
FIG. 5 is a schematic plan view, partly in section, of the modified structure of FIG. 4.
Figure 6:
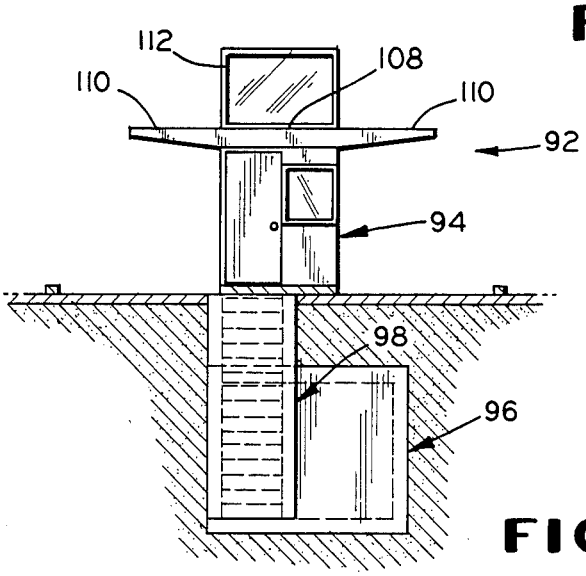
FIG. 6 is a schematic end view of the modified structure of FIGS. 4 and 5.

Referring to FIGS. 4–6, a modified structure for supplying goods or services to customers is indicated at 92. The structure basically includes a ground level building 94 and an underground container 96, with stair means indicated at 98 usually connecting the container and the building.

The modified ground level building 94 is somewhat larger than the building 12 but again can be prefabricated so as to be quickly installed on the site. It includes two side walls 100 and 102 and two end walls 104 and 106 with a flat roof 108 having overhangs 110 for weather protection. A large sign 112 can be mounted on the roof for advertising or for displaying a menu, for example. The end wall 104, in this instance, has an acess door 114 and windows 116 are located at the opposite end of the building by means of which goods or services can be dispensed to customers outside the building. The building 94 can be located on a concrete island 118 with vehicle paths or driveways 120 and 122 located alongside the building. Again, one worker can usually handle vehicles along both of the paths 120 and 122 and communication stations (not shown) can also be provided for customers' vehicles. The end door 114 enables service vehicles to be backed up on the island 118 near the door for supplying goods to the structure 92 or for removing rubbish or trash therefrom.

The underground container 96, in this instance, is made of poured concrete, although concrete blocks may be used if soil conditions permit. The container 96 can be equipped with the same accessories as the container 14 and will not be discussed otherwise in detail.

While part of the container 96 is directly under part of the ground level building 94, most of it is disposed beyond one end of the building 94. With this arrangement, the stair means 98, which includes stairs 124 and a stair passage 126, can be located at the end of the container 96 to provide maximum space utilization within the container. The stair means 98 is located at one side of the container 96 and also at one side of the building 94, adjacent the side wall 102 and near the door 114. The stair means is located at an end portion of the building spaced from the dispensing windows 116. Access to a service vehicle is thereby facilitated without interfering with any dispensing of goods or services at the other end of the building. Conveying means (not shown) can also be provided between the container 96 and the building 94.

Various modifications of the above-described embodiments of the invention will be apparent to those skilled in the art, and it is to be understood that such modifications can be made without departing from the scope of the invention, if they are within the spirit and the tenor of the accompanying claims.

I claim:

1. A structure for supplying goods to customers at ground level, said structure being particularly adapted for small and odd-sized sites, including fringes of shopping center parking lots and the like, said structure comprising a freestanding ground level building having access means through which goods can be dispensed to the customers and through which the customers can pay for the goods, said building being of a sufficient size that a worker can move about therein and dispense goods to the customers by means of said access means, at least one vehicle path extending alongside said building adjacent said access means for customers' autos, an underground container having an internal height sufficient for workers to stand, and stair means connecting said container and said building.

2. A structure according to claim 1 characterized by conveying means connecting said container and said building for supplying items to said building from said container.

3. A structure according to claim 1 characterized by said stair means connecting an end of said container and said building.

4. A structure for supplying goods to customers at ground level, said structure being particularly adapted for small and odd-sized sites, including fringes of shopping center parking lots and the like, said structure comprising a free-standing ground level building having access means by which goods can be dispensed to the customers and through which the customers can pay for the goods, said building being of sufficient size that a worker can move about therein and dispense goods to the customers by means of said access means, at least one vehicle path extending alongside said building adjacent said access means for customers' autos, said building having a door by means of which the worker can enter and exit the building, an underground, enclosed container for workers of a site sufficient that a worker can stand therein and move about, said container having means by which a worker can readily enter and exit said container from above, and conveying means connecting said container and said building for conveying items to be dispensed to customers from said container to said building.

5. A structure according to claim 4 said container means being characterized by said container means being stair means connecting said container and said building.

6. A structure according to claim 5 characterized by said stair means connecting an end of said container with said building.

7. A structure for supplying goods to customers, said structure being particularly adapted for small and odd-sized sites, including fringes of shopping center parking lots and the like, said structure comprising a free-standing ground level building having access means by which goods can be dispensed directly to customers outside the ground by a worker within the building. said building being of sufficient size that a worker can move about therein and dispense goods to the customers by means of said access means, means forming at least one vehicle path extending along one side of the building adjacent said access means for customers' autos, an underground, enclosed container, at least a portion of which is directly under at least a portion of said building, said container providing sufficient room for the storage of items and for workers to stand and move about to process items to be supplied to the customers, stair means connecting an end of said container and said building to enable workers to move therebetween, and conveying means connecting said container and said building for supplying items from said container to said building.

8. A structure according to claim 7 characterized by said stair means being connected to an end of said container.

9. A structure according to claim 7 characterized by said container being a horizontally-disposed cylindrical shell with wall means forming a floor and ceiling therein which provide space with said shell for duct work and pipes.

10. A structure according to claim 7 characterized by all of said building being directly over at least part of said container.

11. A structure according to claim 7 characterized by an additional vehicle path extending along the opposite side of said building.

12. A structure according to claim 7 characterized by a communications station adjacent said vehicle path by means of which customers in vehicles can communicate with a worker in said building.

* * * * *

UNITED STATES PATENT AND TRADEMARK OFFICE

CERTIFICATE OF CORRECTION

PATENT NO. : 4,805,360

DATED : February 21, 1989

INVENTOR(S) : George E. Kuehnl

It is certified that error appears in the above-identified patent and that said Letters Patent is hereby corrected as shown below:

Column 1, line 39, change "fiberreinforced" to --fiber-reinforced--.

Column 4, line 35, change "freestanding" to --free-standing--.

Column 4, line 67, claim 4, line 15, change "site" to --size--.

Column 5, lines 6-7, claim 5, lines 1-2, delete "said container means being".

Column 5, line 19, claim 7, line 7, change "ground" to --building--.

Signed and Sealed this

Eighteenth Day of July, 1989

*Attest:*

*Attesting Officer*

DONALD J. QUIGG

*Commissioner of Patents and Trademarks*